US007727578B2

(12) United States Patent
Guiheen et al.

(10) Patent No.: US 7,727,578 B2
(45) Date of Patent: Jun. 1, 2010

(54) TRANSPARENT CONDUCTORS AND METHODS FOR FABRICATING TRANSPARENT CONDUCTORS

(75) Inventors: James V. Guiheen, Madison, NJ (US); Lingtao Yu, Bloomfield, NJ (US); Kwok-Wai Lem, Randolph, NJ (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 11/964,860

(22) Filed: Dec. 27, 2007

(65) Prior Publication Data

US 2009/0166055 A1 Jul. 2, 2009

(51) Int. Cl.
*B05D 5/12* (2006.01)
*B05D 3/04* (2006.01)
*B05D 1/02* (2006.01)

(52) U.S. Cl. ..... 427/58; 427/98.4; 427/98.6; 427/99.2; 427/377; 427/421.1; 427/428.01; 427/429; 427/430.1

(58) Field of Classification Search ..... 427/58, 427/98.4, 98.6, 99.2, 256, 377, 421.1, 428.01, 427/429, 430.1
See application file for complete search history.

(56) References Cited

U.S. PATENT DOCUMENTS

| | | | |
|---|---|---|---|
| 3,828,218 | A | 8/1974 | Fehnel |
| 4,658,958 | A | 4/1987 | McNulty et al. |
| 5,080,963 | A | 1/1992 | Tatatchuk et al. |
| 5,101,139 | A | 3/1992 | Lechter |
| 5,102,745 | A | 4/1992 | Tarachuck et al. |
| 5,265,273 | A | 11/1993 | Goodwin et al. |
| 5,571,165 | A | 11/1996 | Ferrari |
| 5,576,162 | A | 11/1996 | Papadopoulos |
| 5,578,543 | A | 11/1996 | Tennent et al. |
| 5,614,584 | A | 3/1997 | Schwan et al. |
| 5,707,916 | A | 1/1998 | Snyder et al. |
| 5,752,914 | A | 5/1998 | Delonzor et al. |
| 5,853,877 | A | 12/1998 | Shibuta |
| 5,877,110 | A | 3/1999 | Snyder et al. |
| 6,017,610 | A | 1/2000 | Abe et al. |
| 6,066,448 | A | 5/2000 | Wohlstadter et al. |
| 6,084,007 | A | 7/2000 | Narukawa et al. |

(Continued)

FOREIGN PATENT DOCUMENTS

EP 0908920 A2 4/1999

(Continued)

OTHER PUBLICATIONS

Tao, A, et al., Langmuir-Blodgett Silver Nanowire Monolayers for Molecular Sensing Using Surface-Enhanced Raman Spectroscopy, Nano Letter, vol. 3, No. 9, 2003, pp. 1229-1233.

(Continued)

*Primary Examiner*—Brian K Talbot

(57) ABSTRACT

Transparent conductors and methods for fabricating transparent conductors are provided. In one exemplary embodiment, a method for fabricating a transparent conductor comprises forming a dispersion comprising a plurality of conductive components and a solvent, applying the dispersion to a substrate in an environment having a predetermined atmospheric humidity that is based on a selected surface resistivity of the transparent conductor, and causing the solvent to at least partially evaporate such that the plurality of conductive components remains overlying the substrate.

16 Claims, 3 Drawing Sheets

U.S. PATENT DOCUMENTS

| | | | |
|---|---|---|---|
| 6,184,280 | B1 | 2/2001 | Shibuta |
| 6,235,674 | B1 | 5/2001 | Tennent et al. |
| 6,331,265 | B1 | 12/2001 | Dupire et al. |
| 6,630,772 | B1 | 10/2003 | Bower et al. |
| 6,650,679 | B1 | 11/2003 | Bragin et al. |
| 6,752,977 | B2 | 6/2004 | Smalley et al. |
| 6,785,036 | B1 | 8/2004 | Berneth et al. |
| 6,790,526 | B2 | 9/2004 | Vargo et al. |
| 6,908,572 | B1 | 6/2005 | Derbyshire et al. |
| 6,939,525 | B2 | 9/2005 | Colbert et al. |
| 6,969,504 | B2 | 11/2005 | Smalley et al. |
| 6,988,925 | B2 | 1/2006 | Arthur et al. |
| 7,048,903 | B2 | 5/2006 | Colbert et al. |
| 7,052,666 | B2 | 5/2006 | Colbert et al. |
| 7,060,241 | B2 | 6/2006 | Glatkowski |
| 7,070,754 | B2 | 7/2006 | Smalley et al. |
| 7,105,596 | B2 | 9/2006 | Smalley et al. |
| 7,115,864 | B2 | 10/2006 | Colbert et al. |
| 7,118,693 | B2 | 10/2006 | Glatkowski |
| 7,119,479 | B2 | 10/2006 | Hori et al. |
| 7,195,780 | B2 | 3/2007 | Dennis et al. |
| 2002/0046872 | A1 | 4/2002 | Smalley et al. |
| 2002/0048632 | A1 | 4/2002 | Smalley et al. |
| 2002/0068170 | A1 | 6/2002 | Smalley et al. |
| 2002/0084410 | A1 | 7/2002 | Colbert et al. |
| 2002/0150524 | A1 | 10/2002 | Smalley et al. |
| 2003/0066960 | A1 | 4/2003 | Colbert et al. |
| 2003/0122111 | A1 | 7/2003 | Glatkowski |
| 2003/0158323 | A1 | 8/2003 | Connell et al. |
| 2004/0067329 | A1 | 4/2004 | Okuyama |
| 2004/0099438 | A1 | 5/2004 | Arthur et al. |
| 2004/0116034 | A1 | 6/2004 | Den et al. |
| 2004/0160183 | A1 | 8/2004 | Kim |
| 2004/0186220 | A1 | 9/2004 | Smalley et al. |
| 2004/0197546 | A1 | 10/2004 | Rinzler |
| 2004/0265550 | A1 | 12/2004 | Glatkowski et al. |
| 2005/0074565 | A1 | 4/2005 | Cok |
| 2005/0133779 | A1 | 6/2005 | Choi et al. |
| 2005/0156318 | A1 | 7/2005 | Douglas |
| 2005/0173706 | A1 | 8/2005 | Sasa et al. |
| 2005/0191493 | A1 | 9/2005 | Glatkowski |
| 2005/0195354 | A1 | 9/2005 | Doane et al. |
| 2005/0196707 | A1 | 9/2005 | Cok |
| 2005/0209392 | A1 | 9/2005 | Luo et al. |
| 2005/0221016 | A1 | 10/2005 | Glatkowski et al. |
| 2005/0230560 | A1 | 10/2005 | Glatkowski et al. |
| 2005/0232844 | A1 | 10/2005 | Diner |
| 2005/0236603 | A1 | 10/2005 | Faris |
| 2005/0266162 | A1 | 12/2005 | Luo et al. |
| 2006/0003152 | A1 | 1/2006 | Youngs |
| 2006/0008579 | A1 | 1/2006 | Yamasaki et al. |
| 2006/0054868 | A1 | 3/2006 | Dai |
| 2006/0057290 | A1 | 3/2006 | Glatkowski |
| 2006/0060825 | A1* | 3/2006 | Glatkowski ..... 252/500 |
| 2006/0062983 | A1 | 3/2006 | Irvin et al. |
| 2006/0065902 | A1 | 3/2006 | Todori et al. |
| 2006/0067602 | A1 | 3/2006 | Todori et al. |
| 2006/0078705 | A1 | 4/2006 | Glatkowski et al. |
| 2006/0111008 | A1 | 5/2006 | Arthur et al. |
| 2006/0113510 | A1 | 6/2006 | Luo et al. |
| 2006/0188721 | A1 | 8/2006 | Irvin et al. |
| 2006/0188723 | A1 | 8/2006 | Rowley et al. |
| 2006/0257638 | A1 | 11/2006 | Glatkowski et al. |
| 2006/0274047 | A1 | 12/2006 | Spath et al. |
| 2006/0274048 | A1 | 12/2006 | Spath et al. |
| 2006/0274049 | A1 | 12/2006 | Spath et al. |
| 2007/0036978 | A1 | 2/2007 | Chen |
| 2007/0043158 | A1 | 2/2007 | Smalley et al. |
| 2007/0065651 | A1 | 3/2007 | Glatkowski et al. |
| 2007/0065977 | A1 | 3/2007 | Rinzler |
| 2007/0074316 | A1 | 3/2007 | Alden et al. |
| 2007/0116916 | A1 | 5/2007 | Ito et al. |
| 2007/0120095 | A1 | 5/2007 | Gruner |
| 2007/0120100 | A1 | 5/2007 | Glatkowski et al. |
| 2007/0125418 | A1 | 6/2007 | Suzuki et al. |
| 2007/0141345 | A1 | 6/2007 | Rinzler et al. |
| 2007/0152560 | A1 | 7/2007 | Naito et al. |
| 2007/0153353 | A1 | 7/2007 | Gruner |
| 2007/0153363 | A1 | 7/2007 | Gruner |
| 2007/0158642 | A1 | 7/2007 | Gruner |
| 2007/0264530 | A1 | 11/2007 | Takada et al. |
| 2009/0130433 | A1* | 5/2009 | Takada ..... 428/328 |

FOREIGN PATENT DOCUMENTS

| | | | |
|---|---|---|---|
| JP | 55043126 | | 3/1980 |
| JP | 56153647 | | 11/1981 |
| JP | 57157218 | | 9/1982 |
| JP | 59190829 | | 10/1984 |
| JP | 59213730 | | 12/1984 |
| JP | 02032845 | | 2/1990 |
| JP | 3045985 | | 2/1991 |
| JP | 9147752 | | 6/1997 |
| JP | 10258486 | | 9/1998 |
| JP | 11026984 | | 1/1999 |
| JP | 2000028825 | | 1/2000 |
| JP | 2000174488 | | 6/2000 |
| JP | 2000252681 | | 9/2000 |
| JP | 2002062404 | | 2/2002 |
| JP | 2004165237 | | 6/2004 |
| JP | 2004253796 | | 9/2004 |
| JP | 2005008893 | | 1/2005 |
| JP | 2005084475 | | 3/2005 |
| JP | 2005268688 | | 9/2005 |
| JP | 200577405 | | 10/2005 |
| JP | 2005317888 | | 11/2005 |
| JP | 2006035773 | | 2/2006 |
| JP | 2006127928 | | 5/2006 |
| JP | 2006133528 | | 5/2006 |
| JP | 2006171336 | | 6/2006 |
| JP | 2006173945 | | 6/2006 |
| JP | 2006191009 | | 7/2006 |
| JP | 2006191010 | | 7/2006 |
| JP | 2006191011 | | 7/2006 |
| JP | 2006191012 | | 7/2006 |
| JP | 2006261322 | | 9/2006 |
| JP | 2006285068 | | 10/2006 |
| JP | 2006324203 | | 11/2006 |
| JP | 2007011997 | | 1/2007 |
| WO | 2004069737 | A2 | 8/2004 |
| WO | 2005012171 | A2 | 2/2005 |
| WO | 2005014184 | A1 | 2/2005 |
| WO | 2005028577 | A2 | 3/2005 |
| WO | 2005086982 | A2 | 9/2005 |
| WO | 2005096338 | A1 | 10/2005 |
| WO | 2005110624 | A2 | 11/2005 |
| WO | 2005114324 | A2 | 12/2005 |
| WO | 2005120823 | A2 | 12/2005 |
| WO | 2006030981 | A1 | 3/2006 |
| WO | 2006073420 | A2 | 7/2006 |
| WO | 2006132254 | A1 | 12/2006 |
| WO | 2007002737 | A1 | 1/2007 |
| WO | 2007004758 | A1 | 1/2007 |
| WO | 2007022226 | A2 | 2/2007 |
| WO | 2007024206 | A2 | 3/2007 |
| WO | 2007035838 | A2 | 3/2007 |
| WO | 2007061428 | A2 | 5/2007 |
| WO | 2007064530 | A1 | 6/2007 |
| WO | 2007083772 | | 7/2007 |

OTHER PUBLICATIONS

Using packed silver nanowires as sensitive explosives detector, UC Berkeley News, Sep. 11, 2003, http://berkeley.edu/news/media/releases/2003/09/11_silver.shtml.

Moon, S., et al., 'Transparent conductive film based on Carbon Nanotubes and PEDOT composites', Abstract submited to the Nanotube'05 conference, printed from http://www.fy.chalmers.se/conferences/nt05/abstracts/p214.html on Feb. 15, 2006.
Yu, X ; et al., "Active sound transmission control for windows using carbon nantotube based transparent thin films", printed from URL: www.engineeringvillage2.org.proxy.libraries.rutgers.edu/controller/servlet/Controller on Sep. 12, 2006.
Meitl, M, et al., "Solution casting and transfer printing single-walled carbon nanotube films", Nano Letters 4 (9): pp. 1643-1647 (2004).
Nanotechnology. "How do carbon nanotubes work: carbon nanotube 101." Retrieved on Dec. 6, 2007. Retrieved from Internet: <http://www.nanovip.com/node/2077>.
Zhang, M et al., "Strong Transparent Multifunctional Carbon nanotube Sheets", Science (2005) vol. 309, pp. 1215-1219.
Cao, Q, et al. "Highly Bendable, Transparent Thin Film Transistors that use Carbon Nanotube-based Conductors and semiconductors with elastomeric dielectrics", Adv Mater. 2006, 18, pp. 304-309.
Bo, X Z, et al., "Pentacene-carbon nanotubes: Semiconducting assemblies for thin-film transistor applications", Applied Physics Letters 87 (20): Art. No. 203510 pp. 1-3 (2005).
Saran, N., et al., "Fabrication and characterization of thin films of single-walled carbon nanotube bundles on flexible plastic substrates", Journal of the American Chemical Society 126 (14): pp. 4462-4463 (2004).
Hu, L. et al., "Percolation in transparent and conducting carbon nanotubes networks", Nano Letters 4 (12): pp. 2513-2517 (2004).
Unalan, H, et al., "Design criteria for transparent single-wall carbon nanotube thin-film transistors", Nano Letters 6 (4): pp. 677-682 (2006).
Rowell, M., et al., "Organic solar cells with carbon nanotube network electrodes", Applied Physics Letters 88 (23): Art. No. 233506 pp. 1-3 (2006).
Pasquier, A.et al., "Conducting and transparent single-wall carbon nanotube electrodes for polymer-fullerene solar cells", Applied Physics Letters 87 (20): Art. No. 203511 pp. 1-3 (2005).
Aguirre, C., et al., "Carbon nanotube sheets as electrodes in organic light-emitting diodes", Applied Physics Letters 88 (18): Art. No. 183104 pp. 1-3 (2006).
Li, J, et al. "Organic light-emitting diodes having carbon nanotube anodes", Nano Letters 6 (11): pp. 2472-2477 (2006).
Lee, K, et al., "Single wall carbon nanotubes for p-type ohmic contacts to GaN light-emitting diodes", Nano Letters 4 (5): pp. 911-914 (2004).
Zhang, D., et al., "Transparent, conductive, and flexible carbon nanotube films and their application in organic light emitting diodes", Nano Letters 6 (9): pp. 1880-1886 (2006).
Artukovic, E, et al., "Transparent and flexible carbon nanotube transistors", Nano Letters 5 (4): pp. 757-760 (2005).
Zhou, Y., et al., "p-channel, nchannel thin film transistors and p-n diodes based on single wall carbon nanotube networks", Nano Letters 4 (10): pp. 2031-2035 (2004).
Snow, E. et al., "High-mobility carbon-nanotube thin-film transistors on a polymeric substrate", Applied Physics Letters 86 (3): Art. No. 033105 pp. 1-3 (2005).
Snow, E. et al., "Random networks of carbon nanotubes as an electronic material", Applied Physics Letters 82 (13): pp. 2145-2147 (2003).
Seidel, R. et al., "High-current nanotube transistors", Nano Letters 4 (5): pp. 831-834 (2004).
Hur, S. et al., "Printed thin-film transistors and complementary logic gates that use polymer-coated single-walled carbon nanotubes networks", Journal of Applied Physics 98 (11): Art. No. 114302 pp. 1-6 (2005).
Hur, S. et al., "Extreme bendability of single-walled carbon nanotubes networks transferred from high-temperature growth substrates to plastic and their use in thin-film transistors", Applied Physics Letters 86 (24): Art. No. 243502 pp. 1-3 (2005).
Parekh, B. et al., "Improved conductivity of transparent singlewall carbon nanotube thin films via stable postdeposition functionalization", Applied Physics Letters 90 (12): Art. No. 121913 pp. 1-3 (2007).
Donner., S., et al., "Fabrication of Optically transparent Carbon Electrodes by the pyroloysis of Photoresist Films", Analytical Chmeistry vol. 78, No. 8, Apr. 15, 2006, pp. 2816-2822.
Watson, K., et al., "Transparent, Flexible, Conductive carbon nanotube coatings for electrostatic charge mitigation", Polymer, 46 (2005), pp. 2076-2085.
Geng, H., et al, "Fabrication of transparent conducting films of carbon nanotubes using spray method", IMID/IDMC '06 digest pp. 525-528 (2006).
Moon, J.S., et al., "Transparent conductive film based on Carbon Nanotubes and PEDOT composites", Diamond and Related Materials 14 (2005), pp. 1882-1887.
Ago, H., et al., "Composites of Carbon Nanotubes and Conjugated Polymers for Photovoltaic Devices", Adv. Mater. 1999, 11 No. 15, pp. 1281-1285.
Kaempgen, M., et al., "Transparent carbon nanotubes coatings", Applied Surface Science 252, (2005) pp. 425-429.
Peltola, J., et al, "Carbon Nanotube Tranparent Electrodes for Flexible Displays", Information Display, Feb. 2007, pp. 20-28.
Wu, Z., et al., "Transparent, conductive carbon nanotube films", Science 305 pp. 1273-1276 (2004).
Ginley, D. et al., "Transparent Conducting Oxides", MRS Bulletin, vol. 25, No. 8, pp. 15-21, Aug. 2000.
Lewis, B., et al, "Applications and Processing of Transparent Conducting Oxides", MRS Bulletin, vol. 25, No. 8, pp. 22-27, Aug. 2000.
Gordon, R., "Criteria for Choosing Transparent Conductors", MRS Bulletin, vol. 25, No. 8, pp. 52-57, Aug. 2000.
Peng, K. et al., "Morphological selection of electroless metal deposits on silicon in aqueous fluoride solution" , Electrochimica Acta 49 (2004) pp. 2563-2568.
Kaempgen, M., et al., "Characterization of Carbon Nanotubes by optical spectra", SyntheticMetals 135-136- (2003) pp. 755-756.
Sun, Y., et al., "Uniform Silver Nanowires Synthesis by Reducing AgNO3 with Etthylene Glycol in Presence of Seeds and Poly (vinyl Pyrrolidone)", Chem Mater. 2002, 14, pp. 4736-4745.

* cited by examiner

TRANSPARENT CONDUCTORS AND METHODS FOR FABRICATING TRANSPARENT CONDUCTORS

FIELD OF THE INVENTION

The present invention generally relates to transparent conductors and methods for fabricating transparent conductors. More particularly, the present invention relates to transparent conductors that exhibit conductance that corresponds to the humidity at which the conductors are formed and methods for fabricating such transparent conductors.

BACKGROUND OF THE INVENTION

Over the past few years, there has been an explosive growth of interest in research and industrial applications for transparent conductors. A transparent conductor typically includes a transparent substrate upon which is disposed a coating or film that is transparent yet electrically conductive. This unique class of conductors is used, or is considered being used, in a variety of applications, such as solar cells, antistatic films, gas sensors, organic light-emitting diodes, liquid crystal and high-definition displays, and electrochromic and smart windows, as well as architectural coatings.

Conventional methods for fabricating transparent conductive coatings on transparent substrates include dry and wet processes. In dry processes, plasma vapor deposition (PVD) (including sputtering, ion plating and vacuum deposition) or chemical vapor deposition (CVD) is used to form a conductive transparent film of a metal oxide, such as indium-tin mixed oxide (ITO), antimony-tin mixed oxide (ATO), fluorine-doped tin oxide (FTO), and aluminum-doped zinc oxide (Al—ZO). The films produced using dry processes have both good transparency and good conductivity. However, these films, particularly ITO, are expensive and require complicated apparatuses that result in poor productivity. Other problems with dry processes include difficult application results when trying to apply these materials to continuous and/or large substrates. In conventional wet processes, conductive coatings are formed using the above-identified electrically conductive powders mixed with liquid additives. In all of these conventional methods using metal oxides and mixed oxides, the materials suffer from supply restriction, lack of spectral uniformity, poor adhesion to substrates, and brittleness.

Alternatives to metal oxides for transparent conductors include conductive components such as, for example, silver nanowires and carbon nanotubes. Transparent conductors formed of such conductive components demonstrate transparency and conductivity equal to, if not superior to, those formed of metal oxides. In addition, these transparent conductors exhibit mechanical durability that metal-oxide transparent conductors do not. Accordingly, these transparent conductors can be used in a variety of applications, including flexible display applications. However, the transparency and conductivity of transparent conductors fabricated using conductive components depends on the process by which the conductors are made.

Accordingly, it is desirable to provide methods for fabricating transparent conductors with enhanced transparency and conductivity. In addition, it also is desirable to provide such transparent conductors that do not require expensive or complicated systems. Furthermore, other desirable features and characteristics of the present invention will become apparent from the subsequent detailed description of the invention and the appended claims, taken in conjunction with the accompanying drawings and this background of the invention.

BRIEF SUMMARY OF THE INVENTION

Exemplary embodiments of transparent conductors, and methods for fabricating transparent conductors, wherein the conductivities of the conductors are controlled by controlling the humidities at which the conductors are formed are provided. In accordance with one exemplary embodiment of the present invention, a method for fabricating a transparent conductor comprises forming a dispersion comprising a plurality of conductive components and a solvent and applying the dispersion to a substrate in an environment having an atmospheric humidity that is based on a selected surface resistivity of the transparent conductor. The solvent is caused to at least partially evaporate such that the plurality of conductive components remains overlying the substrate.

A method for fabricating a transparent conductor is provided in accordance with another exemplary embodiment of the present invention. The method comprises providing a substrate, forming a dispersion comprising a plurality of silver nanowires and a solvent, and applying the dispersion to the substrate in an environment having an atmospheric humidity within a range of about 50% to about 70%. The solvent is at least partially evaporated such that the plurality of silver nanowires remains overlying the substrate.

A transparent conductor is provided in accordance with an exemplary embodiment of the present invention. The transparent conductor comprises a substrate and a transparent conductive coating overlying the substrate. The transparent conductive coating comprises a plurality of conductive components, wherein the plurality of conductive components is disposed in a morphology that corresponds to a first humidity at which the transparent conductive coating is applied to the substrate, wherein the morphology comprises more cellular structures than a morphology of a plurality of conductive components of a comparative transparent conductive coating that is disposed on a comparative substrate at a second humidity, the second humidity being less than the first humidity.

BRIEF DESCRIPTION OF THE DRAWINGS

The present invention will hereinafter be described in conjunction with the following drawing figures, wherein like numerals denote like elements, and wherein.

DETAILED DESCRIPTION OF THE INVENTION

The following detailed description of the invention is merely exemplary in nature and is not intended to limit the invention or the application and uses of the invention. Furthermore, there is no intention to be bound by any theory presented in the preceding background of the invention or the following detailed description of the invention.

Transparent conductors described herein exhibit conductance that is determined, at least in part, by the atmospheric humidity of an environment in which the conductors are formed. In particular, the conductance of the transparent conductors may be controlled by controlling the atmospheric humidity at which the transparent conductive coatings of the conductors are applied to the substrate of the conductors. The transparent conductive coatings comprise conductive components that exhibit a morphology that also corresponds to the atmospheric humidity of the environment at which the conductors were formed. As used herein, the term "morphology" refers to the shape, arrangement, orientation, dispersion, distribution, and/or function of the conductive components. It is believed that a higher atmospheric humidity results in a transparent conductor with a higher cellular morphology of the conductive components and this higher cellular morphology results in a higher conductivity of the conductor.

Figure 1:
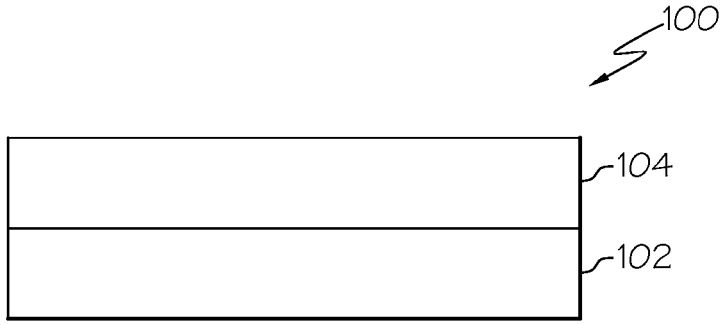
FIG. 1 is a cross-sectional view of a transparent conductor in accordance with an exemplary embodiment of the present invention.

A transparent conductor 100 in accordance with an exemplary embodiment of the present invention is illustrated in FIG. 1. The transparent conductor 100 comprises a transparent substrate 102. A transparent conductive coating 104 is disposed on the transparent substrate 102. The transparency of a transparent conductor may be characterized by its light transmittance (defined by ASTM D1003), that is, the percentage of incident light transmitted through the conductor and its surface resistivity. Electrical conductivity and electrical resistivity are inverse quantities. Very low electrical conductivity corresponds to very high electrical resistivity. No electrical conductivity refers to electrical resistivity that is above the limits of the measurement equipment available. In one exemplary embodiment of the invention, the transparent conductor 100 has a total light transmittance of no less than about 50%. The light transmittance of the transparent substrate 102 may be less than, equal to, or greater than the light transmittance of the transparent conductive coating 104. In another exemplary embodiment of the invention, the transparent conductor 100 has a surface resistivity in the range of about $10^1$ to about $10^{12}$ ohms/square (Ω/sq). In another exemplary embodiment of the invention, the transparent conductor 100 has a surface resistivity in the range of about $10^1$ to about $10^3$ Ω/sq. In this regard, the transparent conductor 100 may be used in various applications such as flat panel displays, touch panels, thermal control films, microelectronics, and the like.

Figure 2:
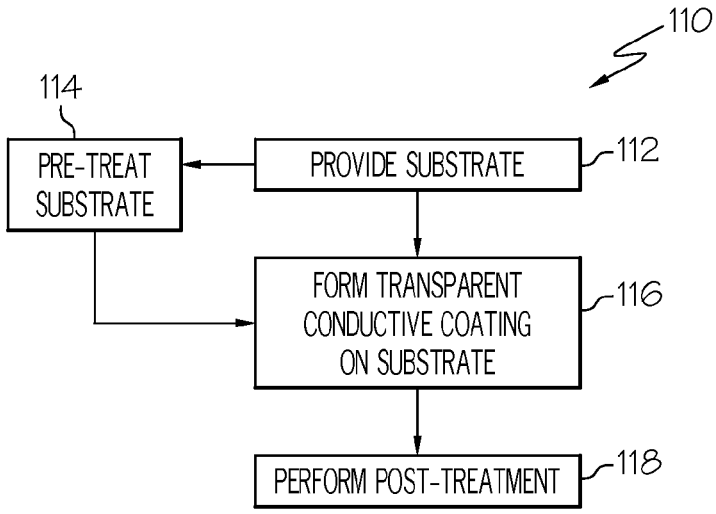
FIG. 2 is a flowchart of a method for fabricating a transparent conductor in accordance with an exemplary embodiment of the present invention.

Referring to FIG. 2, a method 110 for fabricating a transparent conductor, such as the transparent conductor 100 of FIG. 1, comprises an initial step of providing a transparent substrate (step 112). The term "substrate," as used herein, includes any suitable surface upon which the compounds and/or compositions described herein are applied and/or formed. The transparent substrate may comprise any rigid or flexible transparent material. In one exemplary embodiment of the invention, the transparent substrate has a total light transmittance of no less than about 50%. Examples of transparent materials suitable for use as a transparent substrate include glass, ceramic, metal, paper, polycarbonates, acrylics, silicon, and compositions containing silicon such as crystalline silicon, polycrystalline silicon, amorphous silicon, epitaxial silicon, silicon dioxide ($SiO_2$), silicon nitride and the like, other semiconductor materials and combinations, ITO glass, ITO-coated plastics, polymers including homopolymers, copolymers, grafted polymers, polymer blends, polymer alloys and combinations thereof, composite materials, or multi-layer structures thereof. Examples of suitable transparent polymers include polyesters such as polyethylene terephthalate (PET) and polyethylene naphthalate (PEN), polyolefins, particularly the metallocened polyolefins, such as polypropylene (PP) and high-density polyethylene (HDPE) and low-density polyethylene (LDPE), polyvinyls such as plasticized polyvinyl chloride (PVC), polyvinylidene chloride, cellulose ester bases such as triacetate cellulose (TAC) and acetate cellulose, polycarbonates, poly(vinyl acetate) and its derivatives such as poly(vinyl alcohol), acrylic and acrylate polymers such as methacrylate polymers, poly(methyl methacrylate) (PMMA), methacrylate copolymers, polyamides and polyimides, polyacetals, phenolic resins, aminoplastics such as urea-formaldehyde resins, and melamine-formaldehyde resins, epoxide resins, urethanes and polyisocyanurates, furan resins, silicones, casein resins, cyclic thermoplastics such as cyclic olefin polymers, styrenic polymers, fluorine-containing polymers, polyethersulfone, and polyimides containing an alicyclic structure.

In an optional embodiment of the present invention, the substrate may be pretreated to facilitate the deposition of components of the transparent conductive coating, discussed in more detail below, and/or to facilitate adhesion of the components to the substrate (step 114). The pretreatment may comprise a solvent or chemical washing, exposure to controlled levels of atmospheric humidity, heating, or surface treatments such as plasma treatment, UV-ozone treatment, or flame or corona discharge. Alternatively, or in combination, an adhesive (also called a primer or binder) may be deposited onto the surface of the substrate to further improve adhesion of the components to the substrate. Method 110 continues with the formation of a transparent conductive coating, such as transparent conductive coating 104 of FIG. 1, on the substrate (step 116).

Figure 3:
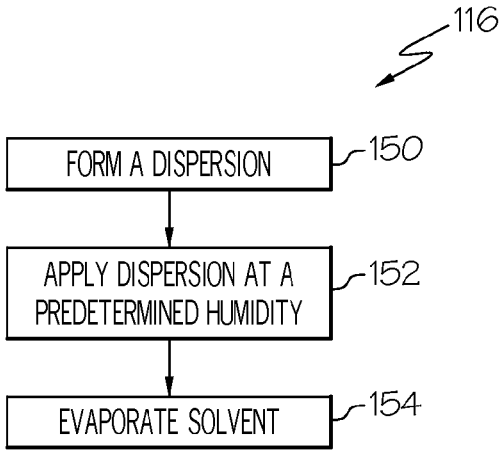
FIG. 3 is a flowchart of a method for fabricating a transparent conductive coating as used in the method of FIG. 2, in accordance with an exemplary embodiment of the present invention.

Referring to FIG. 3, in accordance with an exemplary embodiment of the present invention, the step of forming a transparent conductive coating on a substrate (step 116 of FIG. 2) comprises a process 116 for forming a transparent conductive coating on the substrate in which the conductivity of the resulting transparent conductor is determined by the atmospheric humidity at which the transparent conductive coating is formed on the substrate. Process 116 begins by forming a dispersion (step 150). In one exemplary embodiment, the dispersion comprises at least one solvent and a plurality of conductive components. The conductive components are discrete structures that are capable of conducting electrons. Examples of the types of such conductive structures include conductive nanotubes, conductive nanowires, and any conductive nanoparticles, including metal and metal oxide nanoparticles, and conducting polymers and composites. These conductive components may comprise metal, metal oxide, polymers, alloys, composites, carbon, or combinations thereof, as long as the component is sufficiently conductive. One example of a conductive component is a discrete conductive structure, such as a metal nanowire, which comprises one or a combination of transition metals, such as silver (Ag), nickel (Ni), tantalum (Ta), or titanium (Ti). Other types of conductive components include multi-walled or single-walled conductive nanotubes and non-functionalized nanotubes and functionalized nanotubes, such as acid-functionalized nanotubes. These nanotubes may comprise carbon, metal, metal oxide, conducting polymers, or a combination thereof. Additionally, it is contemplated that the conductive components may be selected and included based on a particular diameter, shape, aspect ratio, or combination thereof. As used herein, the phrase "aspect ratio" designates that ratio which characterizes the average particle size or length divided by the average particle thickness or diameter. In one exemplary embodiment, conductive components contemplated herein have a high aspect ratio, such as at least 100:1. A 100:1 aspect ratio may be calculated, for example, by utilizing components that are 6 microns (μm) by 60 nm. In another embodiment, the aspect ratio is at least 300:1. In one exemplary embodiment of the present invention, the conductive components are silver nanowires (AgNWs), such as, for example, those available from Seashell Technology Inc. of LaJolla, Calif. In another exemplary embodiment, the AgNWs having an average diameter in the range of about 40 to about 100 nm. In a further exemplary embodiment, the AgNWs having an average length in the range of about 1 μm to about 20 μm. In yet another embodiment, the AgNWs having an aspect ratio of about 100:1 to greater than about 1000:1. In one exemplary embodiment of the invention, the silver nanowires comprise about 0.01% to about 4% by weight of the total dispersion. In a preferred embodiment of the invention, the silver nanowires comprise about 0.1 to about 0.6% by weight of the dispersion.

Solvents suitable for use in the dispersion comprise any suitable pure fluid or mixture of fluids that is capable of forming a solution with the conductive components and that may be volatilized at a desired temperature, such as the critical temperature. Contemplated solvents are those that are easily removed within the context of the applications disclosed herein. For example, contemplated solvents comprise relatively low boiling points as compared to the boiling points of precursor components. In some embodiments, contemplated solvents have a boiling point of less than about 250° C. In other embodiments, contemplated solvents have a boiling point in the range of from about 50° C. to about 250° C. to allow the solvent to evaporate from the applied film. Suitable solvents comprise any single or mixture of organic, organometallic, or inorganic molecules that are volatized at a desired temperature.

In some contemplated embodiments, the solvent or solvent mixture comprises aliphatic, cyclic, and aromatic hydrocarbons. Aliphatic hydrocarbon solvents may comprise both straight-chain compounds and compounds that are branched and possibly crosslinked. Cyclic hydrocarbon solvents are those solvents that comprise at least three carbon atoms oriented in a ring structure with properties similar to aliphatic hydrocarbon solvents. Aromatic hydrocarbon solvents are those solvents that comprise generally three or more unsaturated bonds with a single ring or multiple rings attached by a common bond and/or multiple rings fused together. Contemplated hydrocarbon solvents include toluene, xylene, p-xylene, m-xylene, mesitylene, solvent naphtha H, solvent naphtha A, alkanes, such as pentane, hexane, isohexane, heptane, nonane, octane, dodecane, 2-methylbutane, hexadecane, tridecane, pentadecane, cyclopentane, 2,2,4-trimethylpentane, petroleum ethers, halogenated hydrocarbons, such as chlorinated hydrocarbons, nitrated hydrocarbons, benzene, 1,2-dimethylbenzene, 1,2,4-trimethylbenzene, mineral spirits, kerosene, isobutylbenzene, methylnaphthalene, ethyltoluene, and ligroine.

In other contemplated embodiments, the solvent or solvent mixture may comprise those solvents that are not considered part of the hydrocarbon solvent family of compounds, such as ketones (such as acetone, diethylketone, methylethylketone, and the like), alcohols, esters, ethers, amides and amines. Contemplated solvents may also comprise aprotic solvents, for example, cyclic ketones such as cyclopentanone, cyclohexanone, cycloheptanone, and cyclooctanone; cyclic amides such as N-alkylpyrrolidinone, wherein the alkyl has from about 1 to 4 carbon atoms; N-cyclohexylpyrrolidinone and mixtures thereof.

Other organic solvents may be used herein insofar as they are able to aid dissolution of an adhesion promoter (if used) and at the same time effectively control the viscosity of the resulting dispersion as a coating solution. It is contemplated that various methods such as stirring and/or heating may be used to aid in the dissolution. Other suitable solvents include methylisobutylketone, dibutyl ether, cyclic dimethylpolysiloxanes, butyrolactone, γ-butyrolactone, 2-heptanone, ethyl 3-ethoxypropionate, 1-methyl-2-pyrrolidinone, propyleneglycol methyletheracetate (PGMEA), hydrocarbon solvents, such as mesitylene, toluene di-n-butyl ether, anisole, 3-pentanone, 2-heptanone, ethyl acetate, n-propyl acetate, n-butyl acetate, ethyl lactate, ethanol, 2-propanol, dimethyl acetamide, and/or combinations thereof.

The conductive components and solvent are mixed using any suitable mixing or stirring process that forms a homogeneous mixture. For example, a low speed sonicator or a high shear mixing apparatus, such as a homogenizer, a microfluidizer, a cowls blade high shear mixer, an automated media mill, or a ball mill, may be used for several seconds to an hour or more, depending on the intensity of the mixing, to form the dispersion. The mixing or stirring process should result in a homogeneous mixture without damage or change in the physical and/or chemical integrity of the silver nanowires. For example, the mixing or stirring process should not result in slicing, bending, twisting, coiling, or other manipulation of the conductive components that would reduce the conductivity of the resulting transparent conductive coating. Heat also may be used to facilitate formation of the dispersion, although the heating should be undertaken at conditions that avoid the vaporization of the solvent. In addition to the conductive components and the solvent, the dispersion may comprise one or more functional additives. As described above, examples of such additives include dispersants, surfactants, polymerization inhibitors, corrosion inhibitors, light stabilizers, wetting agents, adhesion promoters, binders, antifoaming agents, detergents, flame retardants, pigments, plasticizers, thickeners, viscosity modifiers, rheology modifiers, and photosensitive and/or photoimageable materials, and mixtures thereof.

The next step in the method involves applying the dispersion onto the substrate to reach a desired thickness at a predetermined atmospheric humidity (step 152). The environment within which the dispersion is applied to the substrate has a predetermined atmospheric humidity that corresponds to the desired conductivity of the subsequently-formed transparent conductor. The inventors have found that surface resistivity of the subsequently-formed transparent conductor, and hence the conductivity of the transparent conductor, may be controlled, at least in part, by the atmospheric humidity of the environment within which the dispersion is applied to the substrate. The inventors also have discovered that increased humidity results in transparent conductors with decreased surface resistance and, accordingly, increased conductivity.

Correspondingly, an increase in the atmospheric humidity results in a morphology of conductive components in the resulting transparent conductive coating that has more cellular structures than the morphology of conductive components of a coating prepared in a lower atmospheric humidity. As used herein, the term "cellular structures" means a morphology of conductive components wherein the conductive components are arranged or arrange themselves such that an overall, substantially orderly surface or volumetric distribution is maintained, but wherein individual conductive components are grouped together in clusters that define empty, or partially empty, spaces (or "cells") between the groups of conductive components. The cellular spaces defined by the conductive components clusters may be either open or closed. The cells may define rings, planes, or other volumetric spaces with regular or irregular shapes. Without intending to be bound by theory, it is believed that a higher cellular morphology of the conductive components is responsible, at least in part, for the higher conductivity of the resulting conductor. However, as the atmospheric humidity increases, the potential for artifacts such as bubbles to form in the dispersion also increases. Such artifacts may result in optical defects in the resulting transparent conductive coating. Accordingly, a transparent conductor with a desired conductivity and an acceptable amount of artifacts may be achieved by applying the dispersion to the substrate in an environment having a predetermined atmospheric humidity that is known to achieve such results. In one exemplary embodiment of the invention, the atmospheric humidity is in a range of about 50% to about 70%. In a preferred embodiment of the invention, the atmospheric humidity is in a range of about 55% to about 60%.

In another embodiment of the present invention, an increased humidity higher than that which corresponds to a desired conductivity may be used to offset or compensate for a decrease in the metal content of metal nanowires of the dispersion. For example, when the conductive components comprise silver nanowires, an increased atmospheric humidity—higher than that which corresponds to a conductivity resulting from a first level of silver and lower humidity—may be used to offset a decrease in the silver content of the silver nanowires of the dispersion. In other words, because the silver content of the silver nanowires is, at least partially, responsible for the conductivity of the silver nanowires, a reduction in the silver content of the nanowires will result in a reduction in their conductivity. An increase in atmospheric humidity during the above-described application process may serve to offset a reduction in the silver content of the nanowires and, thus, achieve a transparent conductor that exhibits a desired conductivity and that may be produced at reduced cost.

The dispersion may be applied by, for example, brushing, painting, screen printing, stamp rolling, rod or bar coating, ink jet printing, or spraying the dispersion onto the substrate, dip-coating the substrate into the dispersion, rolling the dispersion onto the substrate, or by any other method or combination of methods that permits the dispersion to be applied uniformly or substantially uniformly to the surface of the substrate.

The solvent of the dispersion then is at least partially evaporated such that any remaining dispersion has a sufficiently high viscosity so that conductive components are no longer mobile in the dispersion on the substrate, do not move under their own weight when subjected to gravity, and are not moved by surface forces within the dispersion (step 154). In one exemplary embodiment, the dispersion may be applied by a conventional rod coating technique and the substrate may be placed in an oven, optionally using forced air, to heat the substrate and dispersion and thus evaporate the solvent. In another example, the solvent may be evaporated at room temperature (about 15° C. to about 27° C.). In another example, the dispersion may be applied to a heated substrate by airbrushing the precursor onto the substrate at a coating speed that allows for the evaporation of the solvent. If the dispersion comprises a binder, an adhesive, or other similar polymeric compound, the dispersion also may be subjected to a temperature that will cure the compound. The curing process may be performed before, during, or after the evaporation process.

Referring back to FIG. 2, after at least partial evaporation of the solvent from the dispersion, the resulting transparent conductive coating may be subjected to a post-treatment to improve the transparency and/or conductivity of the coating (step 118). In one exemplary embodiment, the post-treatment includes treatment with an alkaline, including treatment with a strong base. Contemplated strong bases include hydroxide constituents, such as sodium hydroxide (NaOH). Other hydroxides which may be useful include lithium hydroxide (LiOH), potassium hydroxide (KOH), ammonium hydroxide ($NH_3OH$), calcium hydroxide (CaOH), or magnesium hydroxide (MgOH). Alkaline treatment may be at pH greater than 7, more specifically at pH greater than 12. Without wishing to be bound by theory, one reason this post-treatment may improve the transparency and/or conductivity of the resulting transparent conductive coating may be that a small but useful amount of oxide is formed on the surface of the conductive components, which beneficially modifies the optical properties and conductivity of the conductive components network by forming an oxide film of favorable thickness on top of the conductive components. Another explanation for the improved performance may be that contact between the conductive components is improved as a result of the treatment, and thereby the overall conductivity of the conductive components network is improved. Oxide scale formation may result in an overall expansion of the dimensions of the conductive components and, if the conductive components are otherwise held in a fixed position, may result in a greater component-to-component contact. Another mechanism by which the conductivity could improve is via the removal of any residual coating or surface functional groups that were formed or placed on the conductive components during either component synthesis or during formation of the conductive coating. For example, the alkaline treatment may remove or reposition micelles or surfactant coatings that are used to allow a stable conductive component dispersion as an intermediate process in forming the conductive components coating. The alkaline may be applied by, for example, brushing, painting, screen printing, stamp rolling, rod or bar coating, inkjet printing, or spraying the alkaline onto the transparent conductive coating, dip-coating the coating into the alkaline, rolling the alkaline onto coating, or by any other method or combination of methods that permits the alkaline to be applied substantially uniformly to the transparent conductive coating. In another exemplary embodiment of the invention, it will be understood that the alkaline may be added to the dispersion before application to the substrate. Other finishing steps for improving the transparency and/or conductivity of the transparent conductive coating include oxygen plasma exposure, thermal treatment, and corona discharge exposure. For example, suitable plasma treatment conditions are about 250 mTorr of $O_2$ at 100 to 250 watts for about 30 seconds to 20 minutes in a commercial plasma generator. The transparent conductive coating also may be subjected to a pressure treatment. Suitable pressure treatment includes passing the transparent conductive coating through a nip roller so that the conductive components are pressed closely together, forming a network that results in an increase in the conductivity of the resulting transparent conductor.

The following example illustrates the effect atmospheric humidity has on the surface resistivity, and hence conductance, of transparent conductors formed in environments having varied humidity levels. The example is provided for illustration purposes only and is not meant to limit the various embodiments of the present invention in any way.

EXAMPLE

In an exemplary embodiment of the present invention, four 0.125 mm thick sheets of polyethylene terephthalate (PET) having a light transmittance of at least 90% were provided. Approximately 1.48 grams (g) of a silver nanowire dispersion consisting of 0.019 g of silver nanowires in an isopropanol solution was combined with 3 g of toluene, 0.5 g of isopropyl alcohol, and 0.4 g of SU4924 (25% solids), which is an aliphatic isocyanate-based polyurethane binder available from Stahl USA of Peabody, Mass. The dispersion was mixed using a vortex mixer for 5 minutes. The dispersion then was applied to the surfaces of each of the PET sheets using a #7 Meyer rod (wire wound coating rod). The dispersion was applied to a wet film thickness of approximately 18 μm. The application of the dispersion to the four sheets was performed in different closed environments for each of the four sheets. A first environment comprised 50% atmospheric humidity, a second environment comprised 59% atmospheric humidity, a third environment comprised 64% atmospheric humidity, and a fourth environment comprised 70% atmospheric humidity. The atmospheric humidity of each environment was maintained using commercially-available humidifiers and air conditions. After application of the dispersion to the substrates, each assembly remained in the environment for approximately 2 minutes and then was heated to 80° C. for approximately 5 minutes in forced air to permit the solvent to evaporate and the polyurethane binder to cure. The assemblies then were subjected to a 1 mole aqueous solution of sodium hydroxide for five minutes. The transparency of each sample was measured using a BYK Gardner Haze meter available from BYK Gardner USA of Columbia, Md. The surface resistivity was measured using a Mitsubishi Loresta GP MCP-610 low resistivity meter available from Mitsubishi Chemical Corporation of Japan.

The surface resistivity and the light transmittance of each of the resulting transparent conductors are provided in the following Table:

TABLE

| Atmospheric Humidity (%) | Surface Resistivity (Ohms/sq.) | Light Transmittance (%) |
|---|---|---|
| 50 | $1.1 \times 10^8$ | 87.1 |
| 59 | 200 | 86.6 |
| 64 | 177 | 86.7 |
| 70 | 102 | 86.9 |

As evident from the table, an increase in atmospheric humidity of the environment in which the conductors were formed resulted in a decrease in surface resistivity, and hence an increase in conductivity, of the conductors but had no substantial adverse affect on the light transmittance.

Figure 4:
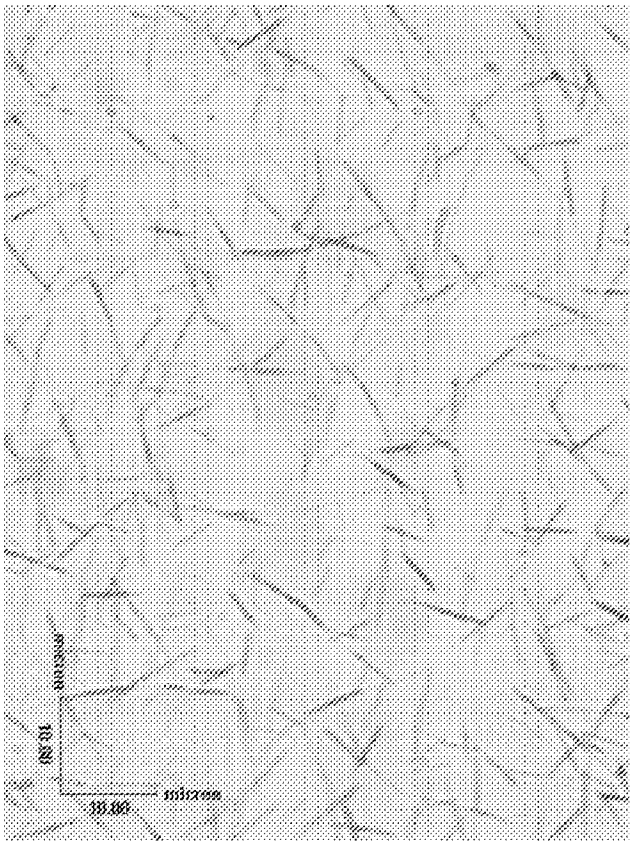
FIG. 4 is a microscopic photograph of a transparent conductor formed by applying a transparent conductive coating to a substrate in an environment having an atmospheric humidity of 50%, the magnification being 500×.
Figure 5:
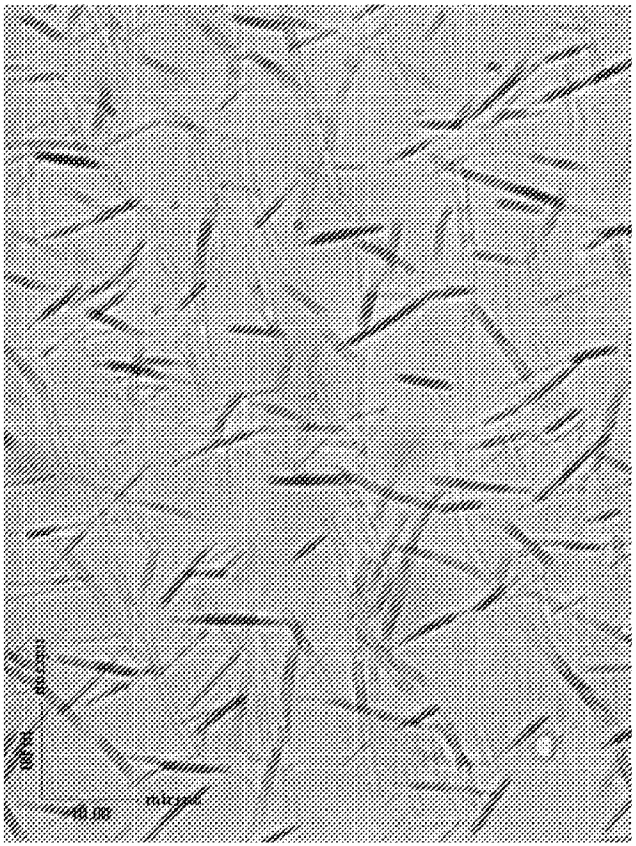
FIG. 5 is a microscopic photograph of a transparent conductor formed by applying a transparent conductive coating to a substrate in an environment having an atmospheric humidity of 59%, the magnification being 500×.
Figure 6:
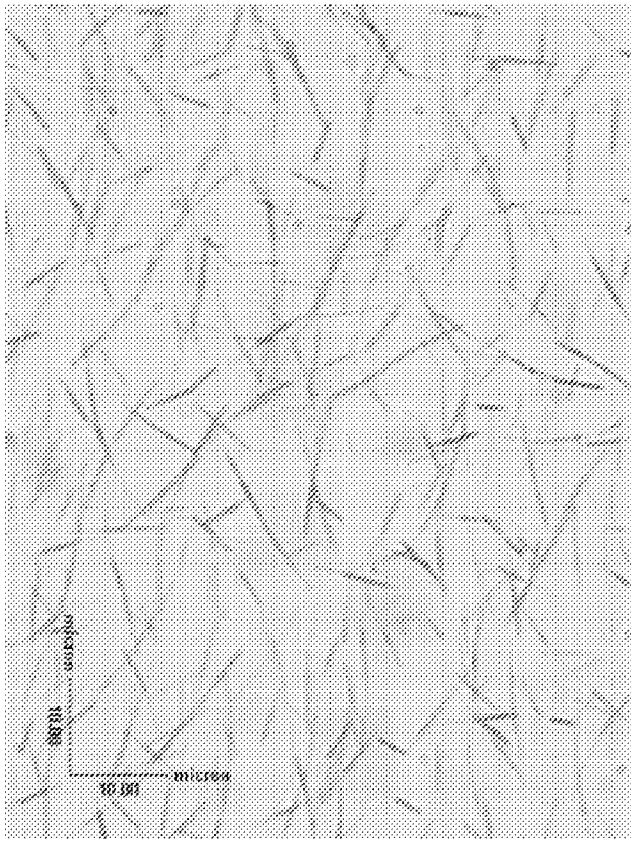
FIG. 6 is a microscopic photograph of a transparent conductor formed by applying a transparent conductive coating to a substrate in an environment having an atmospheric humidity of 64%, the magnification being 500×.
Figure 7:
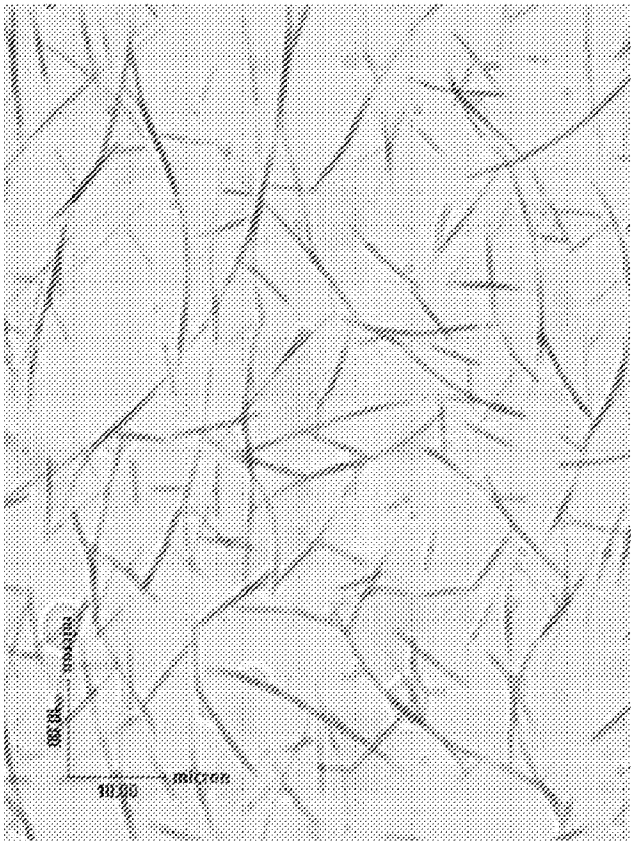
FIG. 7 is a microscopic photograph of a transparent conductor formed by applying a transparent conductive coating to a substrate in an environment having an atmospheric humidity of 70%, the magnification being 500×.

FIGS. 4-7 are photographs of the resulting transparent conductors prepared in 50%, 59%, 64%, and 70% atmospheric humidity, respectively. The photographs were taken using a ZEISS Axiophot 451888 optic microscope at a magnification of 500× and illustrate the morphology of the silver nanowires dispersed in the polyurethane binder of the transparent conductive coating. As evident from the photographs, a transparent conductive coating in which the dispersion was applied to the substrate in an environment having a higher atmospheric humidity results in a morphology of the AgNWs that comprises more cellular structures than the morphology of the AgNWs of a transparent conductive coating formed in an environment having a lower atmospheric humidity. As evident from the figures, the transparent conductive coating in which the dispersion was applied to the substrate in an environment having 64% humidity (FIG. 6) has a morphology of AgNWs that has more cellular structures than the morphology of the AgNWs of the transparent conductive coating formed in 59% humidity (FIG. 5) or 50% humidity (FIG. 4).

Accordingly, transparent conductors that exhibit conductivity that is determined, at least in part, by the atmospheric humidity at which the transparent conductive coatings of the conductors are applied to substrates of the conductors have been provided. In addition, methods for fabricating such transparent conductors have been provided. The atmospheric humidity of the environment in which a transparent conductive coatings is applied to the substrates corresponds to the cellular morphology of the conductive components of the subsequently-formed conductor, and hence corresponds to the conductivity of the conductor. While at least one exemplary embodiment has been presented in the foregoing detailed description of the invention, it should be appreciated that a vast number of variations exist. The foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

What is claimed is:

1. A method for fabricating a transparent conductor having a predetermined first surface resistivity, the method comprising the steps of:

forming a dispersion comprising a first plurality of conductive components and a solvent;

determining a first atmospheric humidity in the range of about 50% to about 70%, the predetermined first surface resistivity based on the first atmospheric humidity;

applying the dispersion to a substrate in an environment having the first atmospheric humidity; and causing the solvent to at least partially evaporate such that the first plurality of conductive components remains overlying the substrate.

2. The method of claim 1, further comprising the step of subjecting the substrate to a pretreatment before applying the dispersion to the substrate.

3. The method of claim 1, wherein the first atmospheric humidity is in the range of about 55% to about 60%.

4. The method of claim 1, wherein the first plurality of conductive components comprises a first plurality of silver nanowires, wherein the predetermined first surface resistivity is based on the first atmospheric humidity when the first plurality of silver nanowires comprises a first silver content, and wherein the first atmospheric humidity is higher than a second atmospheric humidity upon which is based a second surface resistivity equal to the predetermined first surface resistivity when a second plurality of nanowires has a second silver content that is greater than the first silver content.

5. The method of claim 1, wherein the step of applying the dispersion further comprises applying the dispersion by brushing, painting, screen printing, stamp rolling, rod or bar coating, inkjet printing, or spraying the dispersion onto the substrate, dip-coating the substrate into the dispersion, or rolling the dispersion onto the substrate.

6. The method of claim 1, wherein the dispersion comprises dispersants, surfactants, polymerization inhibitors, corrosion inhibitors, light stabilizers, wetting agents, adhesion promoters, binders, antifoaming agents, detergents, flame retardants, pigments, plasticizers, thickeners, viscosity modifiers, rheology modifiers, photosensitive materials, photoimageable materials, or mixtures thereof.

7. The method of claim 1, wherein the step of causing the solvent to at least partially evaporate results in the formation of a transparent conductive coating disposed on the substrate and wherein the method further comprises the step of subjecting the transparent conductive coating to a post-treatment after the step of causing the solvent to at least partially evaporate.

8. The method of claim 7, wherein the post-treatment step comprises subjecting the transparent conductive coating to an alkaline.

9. The method of claim 1, wherein the first plurality of conductive components comprises a plurality of metal nanowires.

10. The method of claim 1, wherein the first plurality of conductive components comprises a plurality of carbon nanotubes.

11. A method for fabricating a transparent conductor, the method comprising the steps of:

providing a substrate;

forming a dispersion comprising a first plurality of silver nanowires and a solvent;

applying the dispersion to the substrate in an environment having an atmospheric humidity within a range of about 50%to about 70%; and at least partially evaporating the solvent such that the first plurality of silver nanowires remains overlying the substrate.

12. The method of claim 11, wherein the atmospheric humidity is within a range of about 55% to about 60%.

13. The method of claim 11, wherein the step of applying the dispersion to a substrate comprises the step of applying the dispersion to the substrate in the environment having a first atmospheric humidity, wherein a first resistivity of the transparent conductor is based on the first atmospheric humidity when the first plurality of silver nanowires comprises a first silver content, and wherein the first atmospheric humidity is higher than a second atmospheric humidity upon which is based a second resistivity equal to the first resistivity when a second plurality of nanowires has a second silver content that is greater than the first silver content.

14. The method of claim 11, wherein the step of applying the dispersion further comprises applying the dispersion by brushing, painting, screen printing, stamp rolling, rod or bar coating, inkjet printing, or spraying the dispersion onto the substrate, dip-coating the substrate into the dispersion, or rolling the dispersion onto the substrate.

15. The method of claim 11, wherein the dispersion comprises a dispersant, a surfactant, a polymerization inhibitor, a corrosion inhibitor, a light stabilizer, a wetting agent, an adhesion promoter, a binder, an antifoaming agent, a detergent, a flame retardant, a pigment, a plasticizer, a thickener, a viscosity modifier, a rheology modifier, a photosensitive material, a photoimageable material, or mixtures thereof.

16. The method of claim 11, wherein the step of causing the solvent to evaporate results in the formation of a transparent conductive coating disposed on the substrate and wherein the method further comprises the step of subjecting the transparent conductive coating to a post-treatment after the step of at least partially evaporating the solvent.

* * * * *